US009573256B2

(12) United States Patent
Hsieh

(10) Patent No.: US 9,573,256 B2
(45) Date of Patent: Feb. 21, 2017

(54) TORQUE SCREWDRIVER

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 331 days.

(21) Appl. No.: 14/223,012

(22) Filed: Mar. 24, 2014

(65) Prior Publication Data

US 2015/0239110 A1 Aug. 27, 2015

(30) Foreign Application Priority Data

Feb. 27, 2014 (TW) ..... 103106772 A

(51) Int. Cl.

| | |
|---|---|
| ***B25B 23/142*** | (2006.01) |
| ***B25B 15/04*** | (2006.01) |
| ***B25B 23/16*** | (2006.01) |
| ***B25B 15/02*** | (2006.01) |

(52) U.S. Cl.

CPC ..... *B25B 23/1427* (2013.01); *B25B 15/02* (2013.01); *B25B 15/04* (2013.01); *B25B 23/16* (2013.01)

(58) Field of Classification Search

CPC .... B25B 23/1427; B25B 23/141; B25B 15/04; B25B 15/02; B25B 23/14; B25B 13/461; B25B 13/465

See application file for complete search history.

(56) References Cited

U.S. PATENT DOCUMENTS

| | | | | |
|---|---|---|---|---|
| 2,601,044 A * | 6/1952 | Mayer | B25B 13/463 | 81/480 |
| 7,430,945 B2 * | 10/2008 | Gauthier | B25B 13/463 | 81/467 |
| 2006/0179981 A1 * | 8/2006 | Cutler | B25B 15/02 | 81/475 |

* cited by examiner

*Primary Examiner* — Robert Scruggs
(74) *Attorney, Agent, or Firm* — Guice Patents PLLC

(57) ABSTRACT

A torque screwdriver includes: a main body having a transverse handle section and a vertical tubular section, the handle section being formed with an internal passage having two cavities respectively formed on two sides of the tubular section; the tubular section being formed with an internal axial space; an operation stem, several ratchets and several recesses being disposed at a top end of the operation stem, each ratchet having a long tooth face and a short tooth face, the long tooth face having a slope smaller than a slope of the short tooth face; the operation stem being mounted in the main body; two elastic abutment assemblies respectively mounted in the two cavities to elastically press two abutment members to elastically contact the operation stem; and at least two support rings disposed between the operation stem and the main body.

11 Claims, 9 Drawing Sheets

TORQUE SCREWDRIVER

BACKGROUND OF THE INVENTION

1. Field of the Invention

The present invention relates generally to a hand tool, and more particularly to a torque screwdriver.

2. Description of the Related Art

FIGS. 1 and 2 show a conventional torque tool 10. The torque tool 10 includes a main body 12. Two sides of the main body 12 are respectively formed with two cavities 13. A top end of an operation stem 14 is pivotally rotatably connected in a shaft hole 121 of the main body 12. The circumference of the operation stem 14 is formed with six teeth 15 and six locating troughs 16 between the six teeth 15. Two elastic abutment assemblies 17 are disposed in the two cavities 14. Each elastic abutment assembly 17 includes a steel ball 18 and a spring 19. The spring 19 applies an elastic force to the steel ball 18 to make the steel ball 18 elastically abut against the circumference of the operation stem 14.

In general, the steel ball 18 is positioned in the locating trough 16 as shown in FIG. 2. The torque tool 10 is used to screw a screw or a nut or the like. When the torque of the tool is about to reach a set torque value, the spring 19 is compressed as shown in FIG. 3. At this time, the steel ball 18 is moved along the tooth face 151 of the tooth 15 to the tooth crest and the main body 12 is rotated around the operation stem 14. When the steel ball 19 is moved to the tooth crest, the tool 10 provides a maximum torque. In the instant of reaching the maximum torque, the steel ball 18 slides over a tooth 15 to fall into the next locating trough 16 and restore to the state as shown in FIG. 2. The click of falling into the locating trough 16 can alert a user that the torque of the tool has reached the set torque value.

The above torque tool 10 is a two-way torque tool, which can be operated clockwise and counterclockwise. However, in order to operate the torque tool 10 in two directions, the width of the tooth 15 is narrowed so that the tooth face 151 is quite steep. The tooth face 151 has a large slope and quite short length. Therefore, when reaching the set torque value, the steel ball 18 will abruptly move from the tooth valley, (that is, the locating trough 16 as shown in FIG. 2), to the tooth crest in a very short time. Also, the spring 19 is abruptly compressed in a very short time. Therefore, in operation of the tool, the torque of the tool will instantaneously greatly change. As a result, the torque tool can hardly provide a precise torque.

Furthermore, as shown in FIG. 1, the top end of the operation stem 14 of the tool 10 is pivotally disposed in the shaft hole 121 of the main body 12. The operation stem 14 is not well supported and is likely to shake. Also, the operation stem directly abrades the wall of the shaft hole 121 against a great frictional force. Therefore, the torque value of the conventional torque tool is unstable and the torque tool can be hardly smoothly operated.

In addition, the tool has no waterproof design so that the internal components are apt to rust or culture bacteria. In this case, the tool cannot be used in an environment requiring high sanitary condition.

SUMMARY OF THE INVENTION

It is therefore a primary object of the present invention to provide a torque screwdriver, which has more precise and stable torque value.

It is a further object of the present invention to provide the above torque screwdriver, which has waterproof function.

To achieve the above and other objects, the torque screwdriver of the present invention includes:

a main body having a T-shaped configuration, the main body having a transverse handle section and a vertical tubular section connected to the handle section, the handle section being formed with an internal passage, the passage having two cavities respectively formed on two sides of the tubular section, the tubular section being formed with an internal axial space;

an operation stem, several ratchets and several recesses formed between the ratchets being disposed at a top end of the operation stem, each ratchet having a long tooth face on one side and a short tooth face on the other side, the long tooth face having a slope smaller than a slope of the short tooth face, a drive end being disposed at bottom end of the operation stem, the operation stem being fitted in the tubular section of the main body, the ratchets and the recesses being positioned in the passage of the handle section;

two elastic abutment assemblies respectively mounted in the two cavities of the main body, each abutment assembly having an abutment member and an elastic member, the abutment member being engaged with the ratchets of the operation stem, an inner end of the elastic member pressing the abutment member to make the abutment member elastically contact the operation stem; and at least two support rings disposed between the operation stem and the main body, when the operation stem is rotated within the main body, the support rings supporting the operation stem.

According to the above arrangement, during the operation of the torque screwdriver, the torque of the torque screwdriver changes more gently so that the precision of the torque value can be ensured.

Preferably, several leakproof members are disposed in the main body to achieve waterproof effect for the screwdriver.

The present invention can be best understood through the following description and accompanying drawings, wherein:

DETAILED DESCRIPTION OF THE PREFERRED EMBODIMENTS

Figure 1:
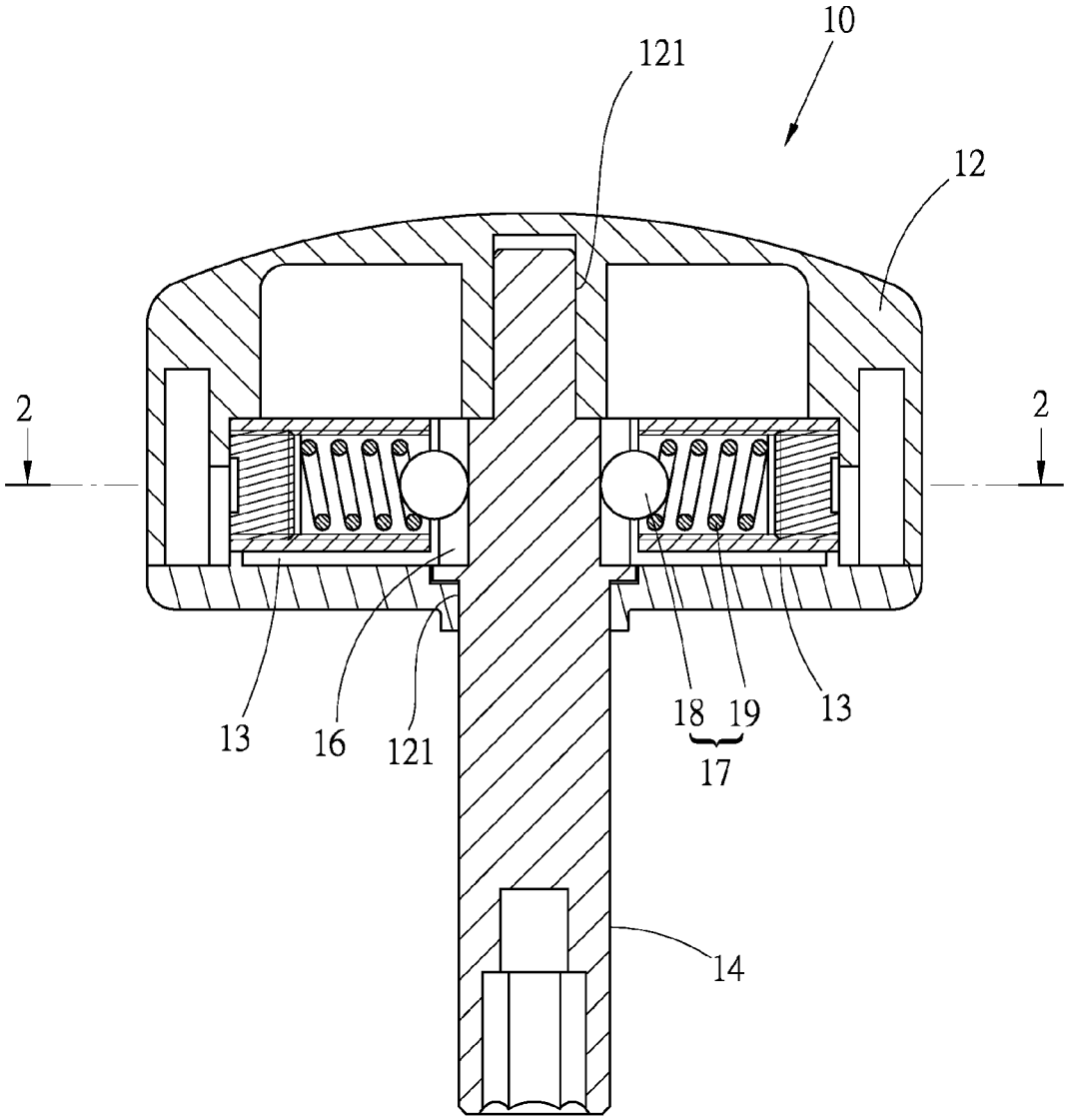
Fig. 1 PRIOR ART
FIG. 1 is a longitudinal sectional view of a conventional torque tool.
Figure 2:
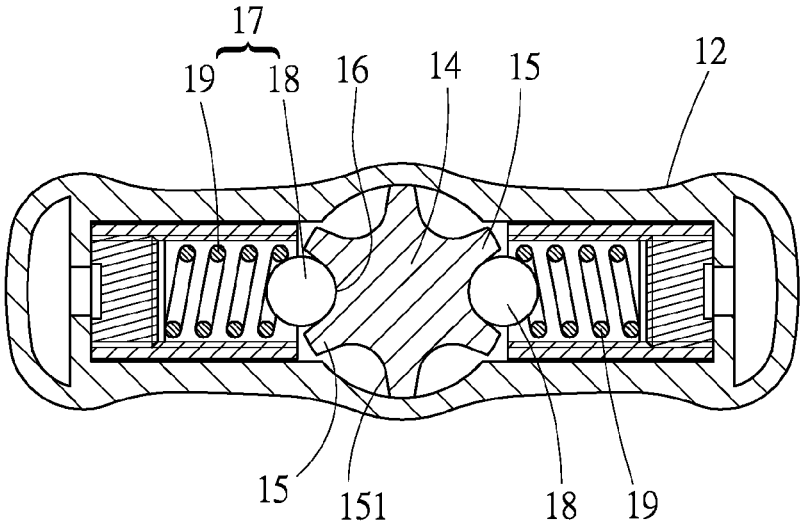
Fig. 2 PRIOR ART
FIG. 2 is a sectional view taken along line 2-2 of FIG. 1.
Figure 3:
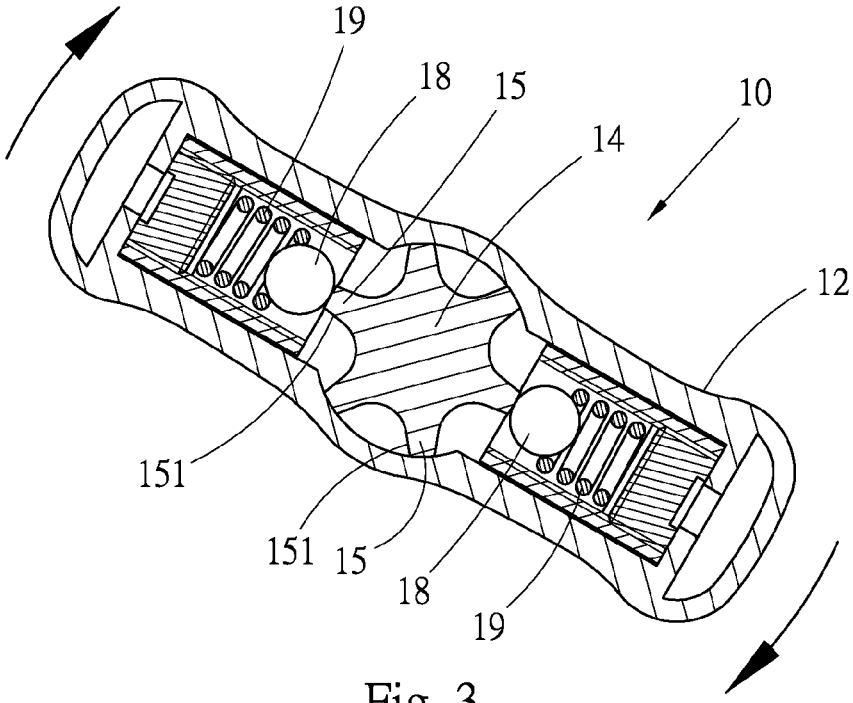
Fig. 3 PRIOR ART
FIG. 3 is a sectional view according to FIG. 2, showing the operation of the conventional torque tool.
Figure 4:
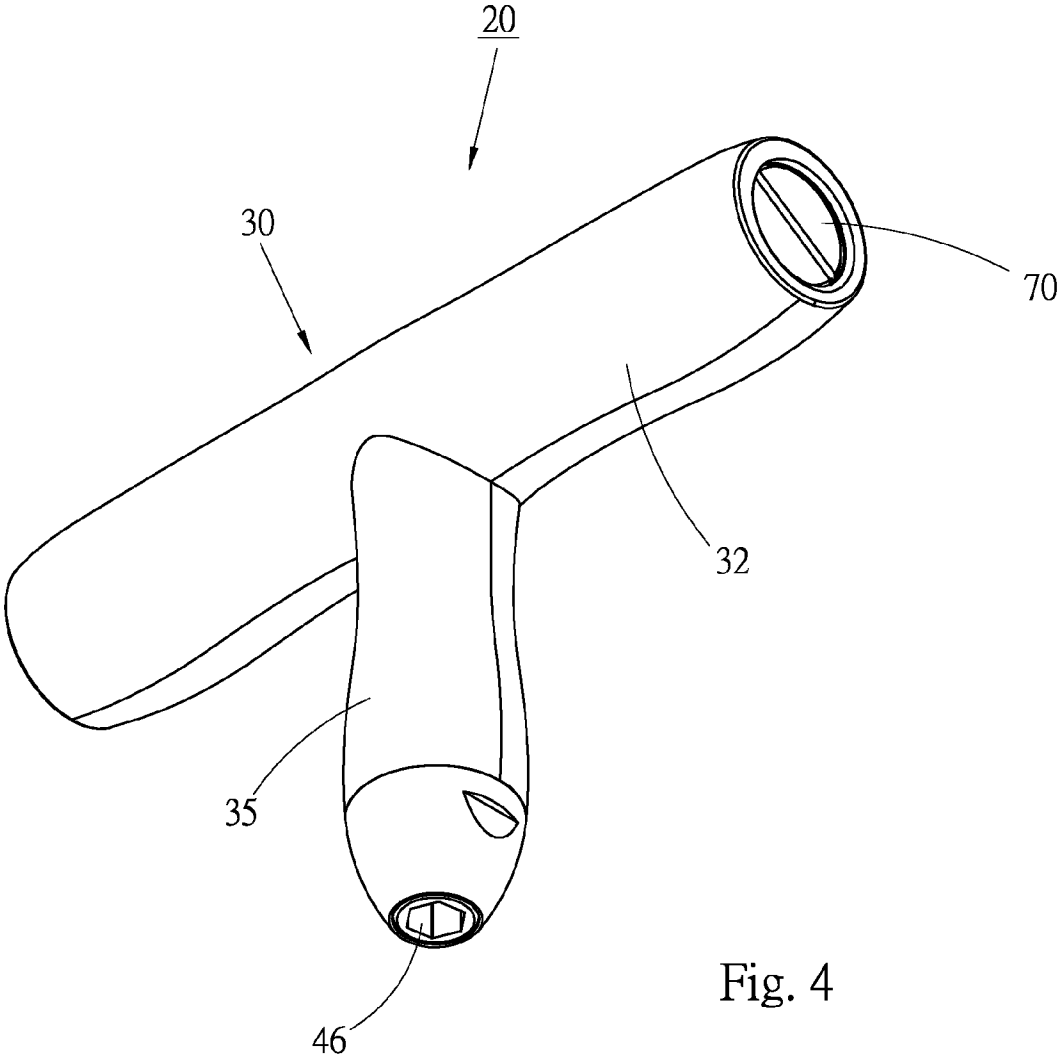
FIG. 4 is a perspective view of a preferred embodiment of the present invention.
Figure 5:
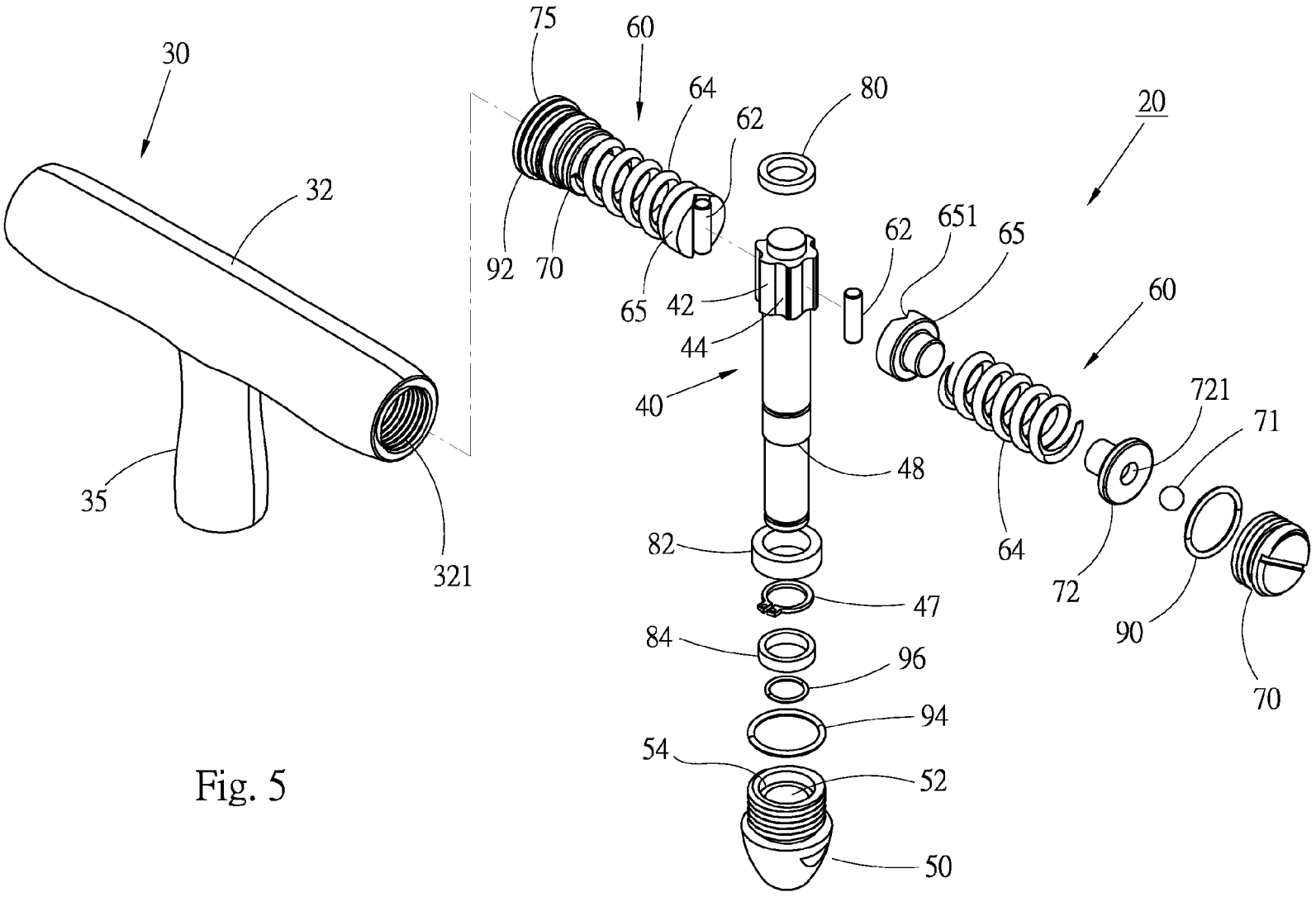
FIG. 5 is a perspective exploded view of the preferred embodiment of the present invention.
Figure 6:
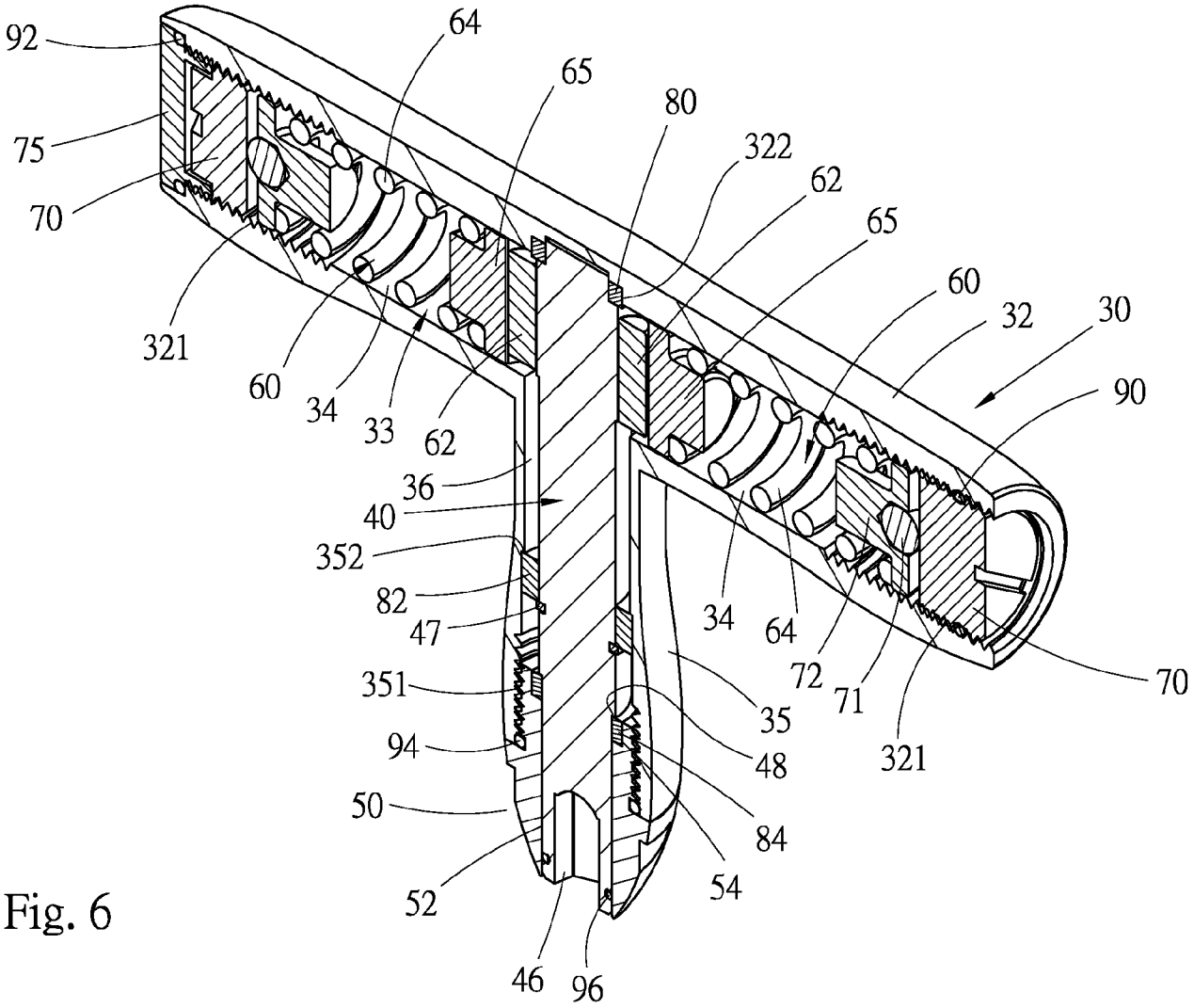
FIG. 6 is a perspective sectional view according to FIG. 4.
Figure 7:
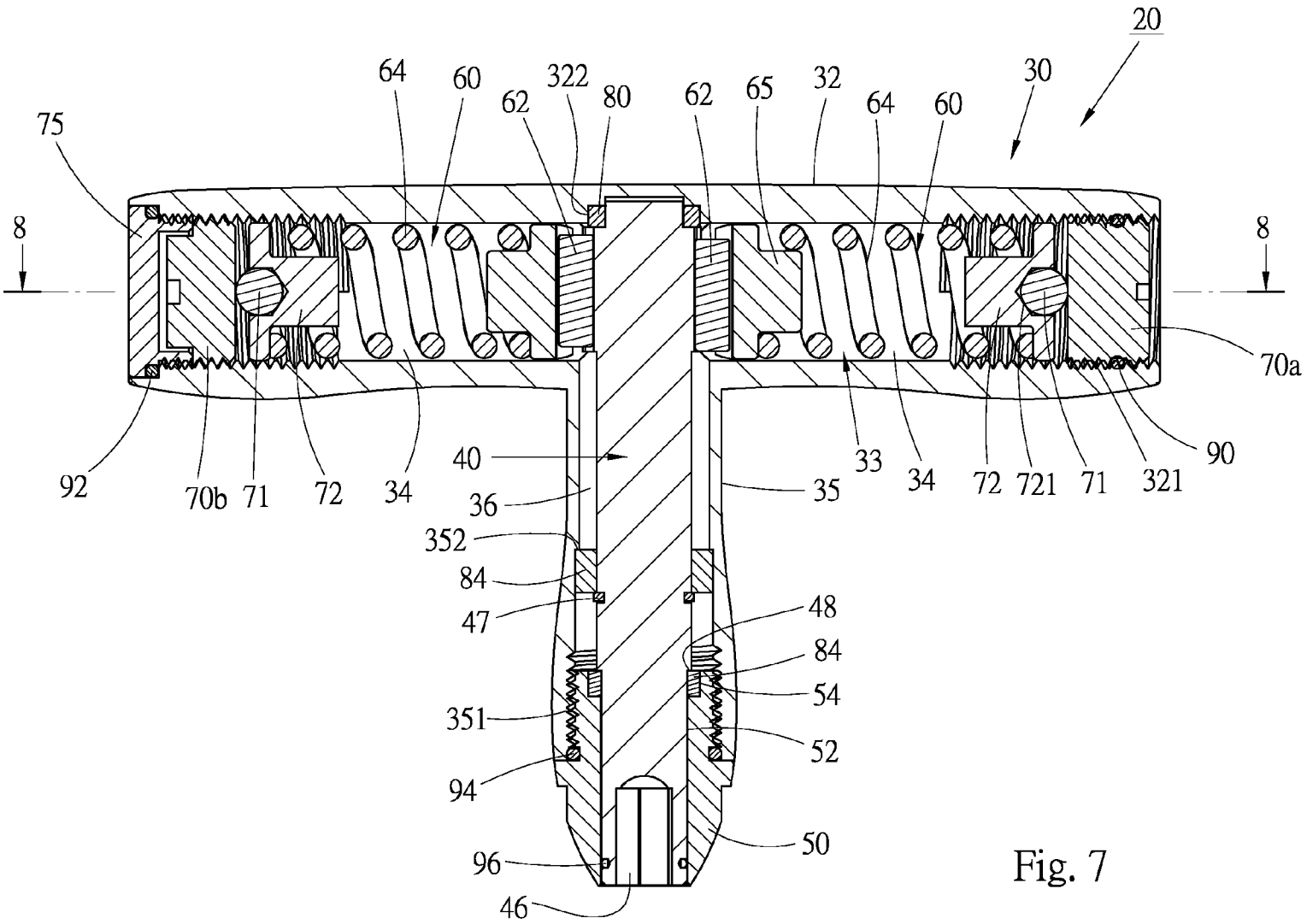
FIG. 7 is a front view according to FIG. 6.

Please refer to FIGS. 4 to 7. According to a preferred embodiment, the torque screwdriver 20 of the present invention includes a main body 30, an operation stem 40 and two elastic abutment assemblies 60.

The main body 30 is a case of the screwdriver 20. The main body 30 is hollow and has a T-shaped configuration. The main body 30 has a transverse handle section 32 and a vertical tubular section 35. The handle section 32 is formed with an internal passage 33 at least passing through one end of the handle section. In this embodiment, the internal passage 33 passes through the handle section from one end to the other end. The tubular section 35 is connected to the center of bottom side of the handle section 32. The tubular section 35 is formed with an internal axial space 36 in communication with the passage 33. The passage 33 has two cavities 34 respectively formed on two sides of the tubular section 35. The inner circumferences of two ends of the handle section 32 and the inner circumference of bottom end of the tubular section 35 are respectively formed with threads 321, 351.

An engagement section is disposed on the circumference of top end of the operation stem 40. The engagement section has several ratchets 42 and several recesses 44 formed between the ratchets 42. The ratchets 42 and the recesses 44 are annularly arranged on the circumference of the operation stem at equal intervals. In this embodiment, there are six ratchets and six recesses. The ratchets 42 allow the operation stem 40 to be one-way rotated and hinder the operation stem 40 from being two-way rotated. Please also refer to FIG. 10. Each ratchet 42 is such configured that the ratchet 42 has a long tooth face 421 on one side and a short tooth face 422 on the other side. The long tooth face 421 is a slope or an arched face. The length of the long tooth face 421 is longer than the length of the short tooth face 422, for example, 2 to 2.5 times longer than the length of the short tooth face 422. Therefore, the slope of the long tooth face is smaller and the long tooth face is relatively gentle, while the slope of the short tooth face 422 is larger. A drive end 46 is disposed at bottom end of the operation stem. As shown in the drawings, the drive end 46 can be a polygonal fitting hole for fitting on a threaded member (nut or bolt) or fitting with a screwdriver bit. Alternatively, a socket can be installed in the fitting hole to fit with a screwdriver bit or fit on a threaded member. The drive end 46 also can be formed as a flathead screwdriver bit or a cross-head screwdriver bit. The operation stem 40 is fitted in the tubular section 35. The ratchets 42 of the top end of the operation stem 40 are positioned in the passage 33 of the handle section 32. The operation stem 40 is rotatable within the main body 30.

A bottom cap 50 is formed with an axial through hole 52. The bottom cap 50 is screwed in the thread 351 of the bottom end of the tubular section 35. The drive end 46 of the operation stem 40 is fitted through the through hole 52 or extends out of the bottom cap 50.

The two abutment assemblies 60 have identical structures and are respectively mounted in the two cavities 34. Each abutment assembly 60 mainly has an abutment member 62 and an elastic member 64. In this embodiment, the abutment member 62 is a cylindrical pin for engaging with the engagement section of the operation stem 40. The abutment member 62 has a length equal to a length of the ratchet 42 from top side to bottom side. This can enhance the engagement effect between the abutment member and the ratchet and increase the strength of the screwdriver. The elastic member 64 is a compression spring. An inner end of the elastic member 64 presses the abutment member 62 via a push tray 65 to make the abutment member elastically contact the operation stem 40. An inner end face of the push tray 65 is formed with a V-shaped channel 651 for locating the abutment member therein. Two adjustment members 70 are screwed in the threads 321 of the inner circumferences of the two ends of the handle section 32. Each adjustment member 70 abuts against and supports outer end of the elastic member 64 via an assembly of a ball body 71 and a tray body 72. When rotating the adjustment member 70, the adjustment member is moved in an axial direction of the cavity 34 to change the elastic force applied by the elastic member 64 to the abutment member 62 so as to adjust the torque of the screwdriver 20. The ball body 71 is received in a blind hole 721 of the tray body 72. Two ends of the ball body 71 respectively contact the adjustment member 70 and the tray body 72 so as to reduce the friction between the adjustment member and the tray body.

When released from a factory, the torque screwdriver 20 has been preset with a torque value. That is, the two adjustment members 70 are positioned in proper positions where the two abutment members 60 engage with the ratchets of the operation stem 40 by a preset elastic energy. An end cap 75 is plugged in a second end of the handle section 34 such as a left end of the handle section 34 to block the second end thereof. The first adjustment member 70 positioned at a first end of the handle section such as a right end of the handle section is still exposed to outer side. In this case, the torque of the screwdriver can be adjusted by means of driving the first adjustment member 70. In this embodiment, a user can only adjust the torque of the screwdriver from one end of the handle section 34.

In addition, according to the preferred embodiment, the screwdriver of the present invention further includes multiple support rings and leakproof members. The support rings are metal ring bodies with certain flexibility. For example, the support rings are, but not limited to, copper rings, aluminum rings or silver rings, and preferably copper rings. In this embodiment, there are three support rings 80, 82, 84 disposed between the operation stem 40 and the main body 30. The three support rings 80, 82, 84 are respectively fitted around a top section, a middle section and a bottom section of the circumference of the operation stem 40 and positioned between the circumference of the operation stem 40 and the inner wall face of the main body 30. The upper support ring 80 is fitted around the top end of the operation stem 40 and received in an annular groove 322 formed on a top inner wall face of the handle section 32. The middle support ring 82 is disposed in the axial space 36 and fitted around the middle section of the operation stem 40. An inner circumference and an outer circumference of the middle support ring 82 are respectively in contact with the circumference of the operation stem and the inner wall face of the tubular section 35. A top edge and a bottom edge of the middle support ring 82 respectively abut against a shoulder section 352 formed on the inner wall face of the tubular section and a first abutment edge 47 disposed on the circumference of the body of the operation stem 40. The first abutment edge 47 is formed of a retainer ring secured on the operation stem. The lower support ring 84 is received in an annular chamber 54 formed on an inner circumference of top end of the bottom cap 50. An inner circumference and an outer circumference of the lower support ring 84 are respectively in contact with the circumference of the operation stem and the wall face of the annular chamber 54. A top end of the lower support ring 84 abuts against a second abutment edge 48 disposed on the circumference of the operation stem 40. Accordingly, the operation stem 40 is well supported in the main body 30 by the three support rings 80, 82, 84. Moreover, the circumference of the operation stem abuts against the three support rings to securely locate the operation stem. Under such circumstance, the operation stem 40 will not loosen or shake within the main body 30. Also, the frictional force between the operation stem and the three support rings is small. This enables the operation stem to be smoothly rotated.

The leakproof members are O-rings including a first leakproof member 90, a second leakproof member 92, a third leakproof member 94 and a fourth leakproof member 96. Please refer to FIG. 7. The first leakproof member 90 is disposed between the first adjustment member 70*a* and the handle section 34. The second leakproof member 92 is disposed between the end cap 75 and the handle section 34. It should be noted that the second leakproof member 92 can be alternatively disposed between the second adjustment member 70*b* and the handle section 34. The third leakproof member 94 is disposed between the bottom cap 50 and the tubular section 35. The fourth leakproof member 96 is disposed between the operation stem 40 and the through hole 52 of the bottom cap 50. Accordingly, the screwdriver 20 has waterproof effect and the internal components of the screwdriver are not apt to rust or culture bacteria.

Figure 8:
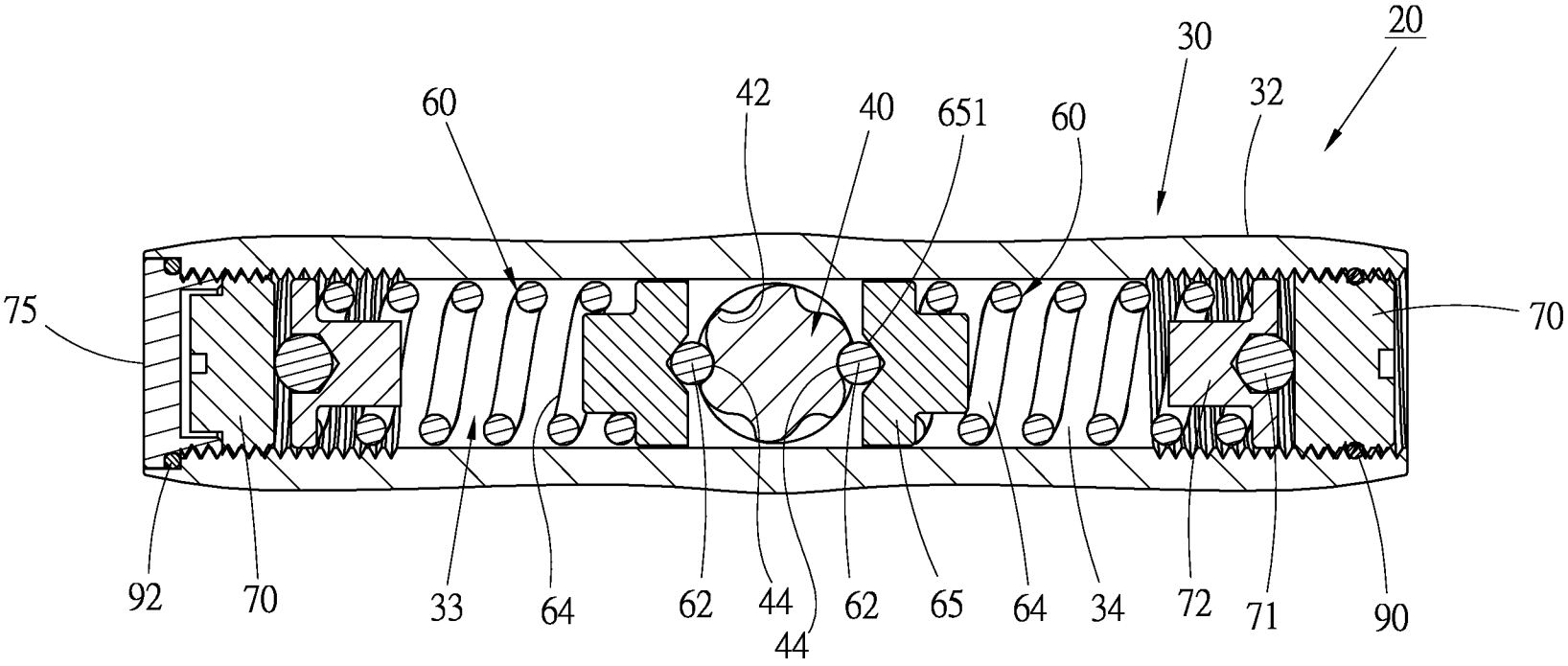
FIG. 8 is a sectional view taken along line 8-8 of FIG. 7.

When not used, no torque is applied to the screwdriver 20. Therefore, the abutment member 62 of the elastic abutment assembly 60 falls into the recess 44 of the operation stem 40 as shown in FIG. 8.

Figure 9:
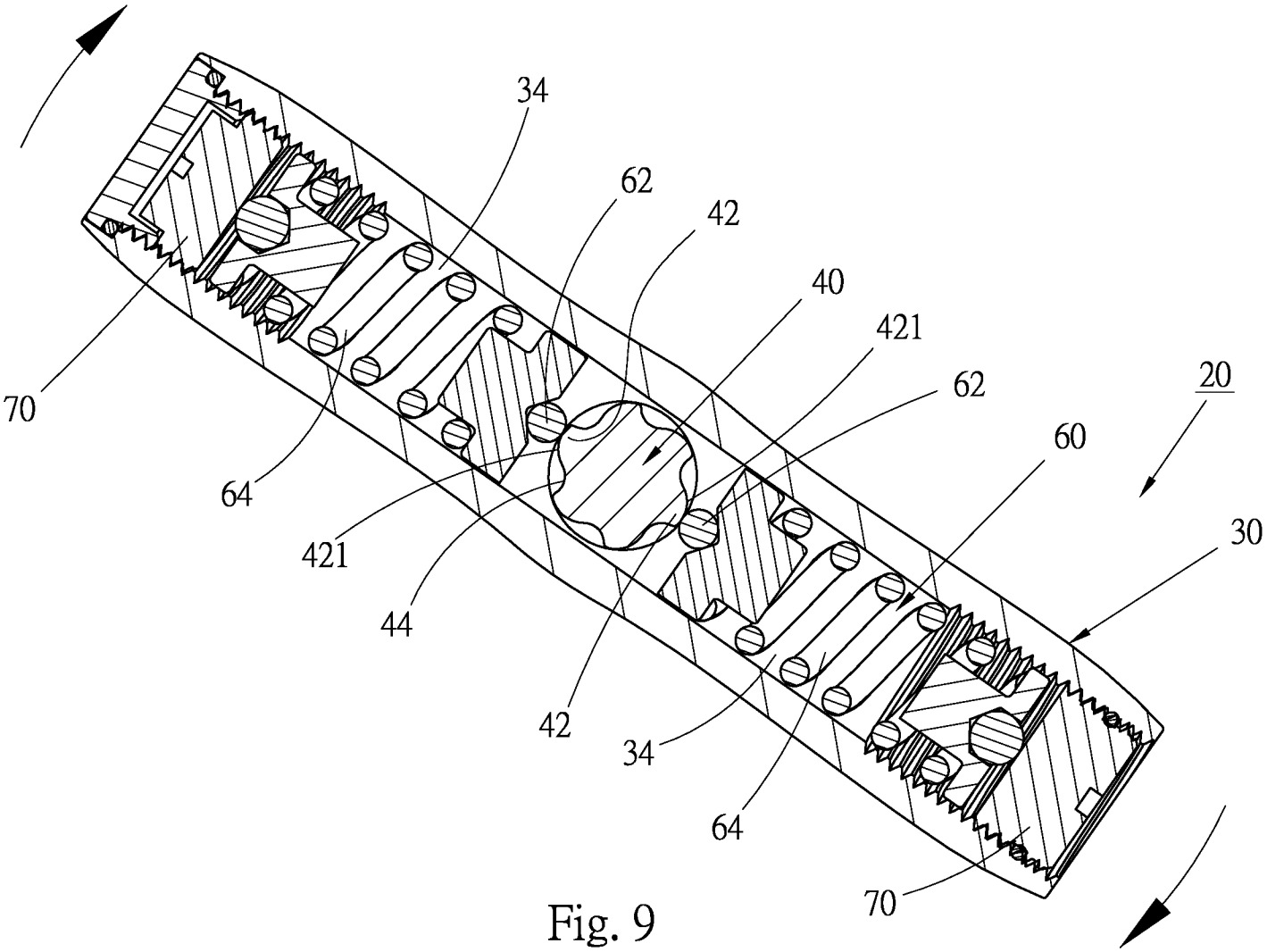
FIG. 9 is a sectional view according to FIG. 8, showing the operation of the torque screwdriver of the present invention.

When using the screwdriver 20 to screw a threaded member and the torque of the screwdriver is about to reach the set torque value, the abutment member 62 is moved from the tooth valley (the recess 44) between the ratchets along the long tooth face 421 of the ratchet 42 to the tooth crest of the ratchet as shown in FIG. 9. At this time, the two elastic members 64 are compressed and the main body 12 is rotated relative to the operation stem 14. When the abutment member 62 is moved to the tooth crest, the screwdriver 20 provides a maximum torque. When the applied force of a user is greater than the set maximum torque of the screwdriver, the abutment member 62 will slide over the tooth crest of the ratchet to fall into the next recess 44 and restore to the engaged state as shown in FIG. 8. The shock and click of the abutment member 62 that falls into the recess will alert the user that the torque of the screwdriver has reached the set torque value and warn the user to stop operating the screwdriver.

Figure 10:
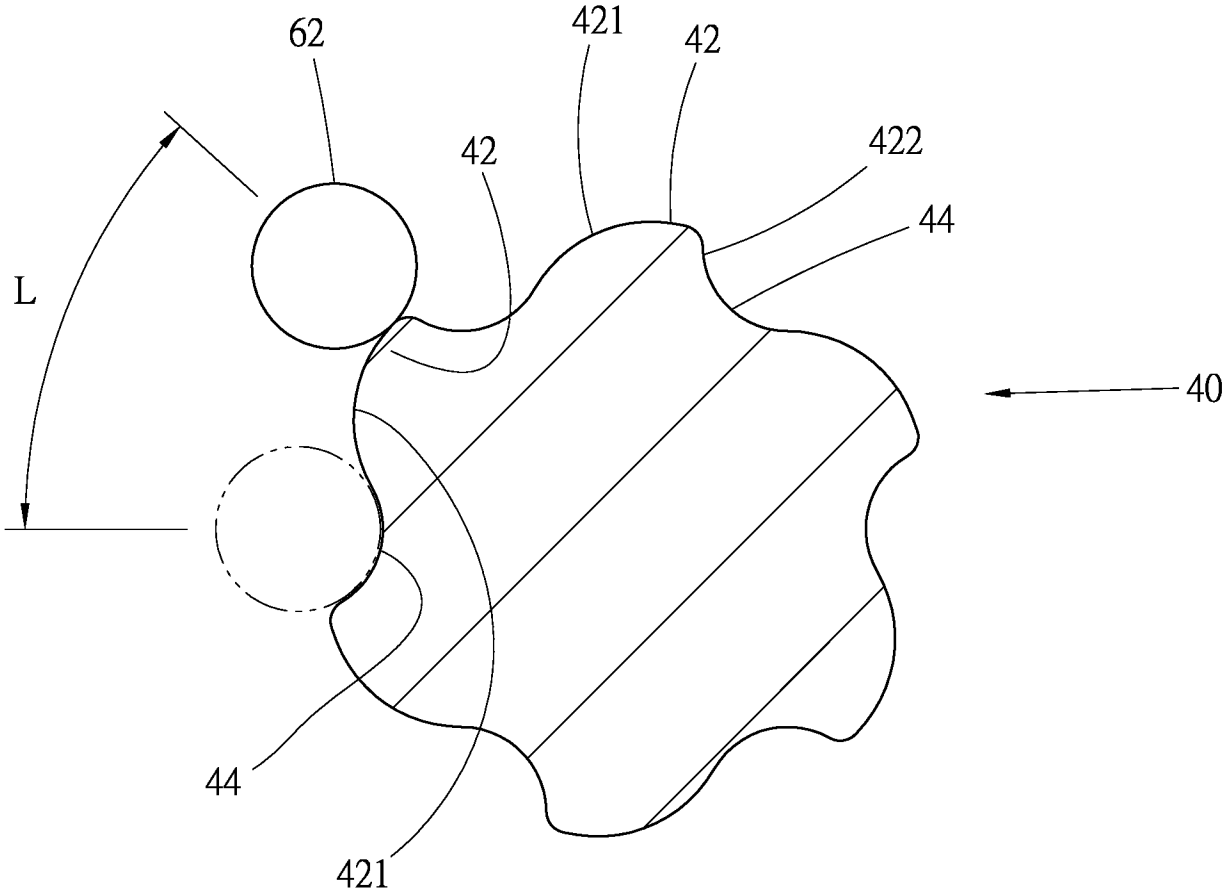
FIG. 10 is a view showing the operation relationship between the abutment member and the ratchet.

Please refer to FIG. 10, which shows the cooperation relationship between the abutment member 62 and the ratchet 42. When the torque of the screwdriver increases from zero torque load to the set torque value, the abutment member 62 is moved from the tooth valley (the recess 44) between the ratchets 42 along the long tooth face 421 of the ratchet 42 to the tooth crest of the ratchet. The slope of the long tooth face 421 is small and the distance of the long tooth face 421 is long. Accordingly, when the torque of the screwdriver reaches the set torque value, the abutment member 62 is moved from the tooth valley to the tooth crest by a travel L. The travel L is relatively long so that the abutment member can gently move along the long tooth face 421. In this case, the elastic member 64 is also gently compressed. Accordingly, during the operation of the screwdriver, the change extent of the torque of the screwdriver is small without rush and the precision of the torque of the screwdriver is increased.

Moreover, according to the structure of the present invention, the operation stem 40 is well supported and located in the main body 30 by the support rings so that the operation stem can be stably rotated to ensure the stability and unification of the torque value of the screwdriver and lower the error. In addition, the support rings serve to reduce the frictional force against the rotation of the operation stem so that the precision of the torque value of the screwdriver can be maintained.

The support rings are easy to manufacture and obtain at low cost. Therefore, the torque screwdriver of the present invention can be stably operated without increasing the manufacturing cost.

The torque screwdriver of the present invention is waterproof so that it can be used in an environment requiring higher sanitary condition such as a medical institute.

The above embodiments are only used to illustrate the present invention, not intended to limit the scope thereof. Many modifications of the above embodiments can be made without departing from the spirit of the present invention.

What is claimed is:

1. A torque screwdriver comprising:

a hollow main body having a T-shaped configuration, the main body having a transverse handle section and a vertical tubular section connected to the handle section, the handle section being formed with an internal passage, the passage having two cavities respectively formed on two sides of the tubular section; a top end of the tubular section being connected to a bottom side of the handle section, the tubular section being formed with an internal axial space in communication with the passage;

an operation stem, several ratchets and several recesses formed between the ratchets being annularly disposed on a circumference of a top end of the operation stem, each ratchet having a long tooth face on one side and a short tooth face on the other side, the long tooth face having a slope smaller than a slope of the short tooth face, a drive end being disposed at a bottom end of the operation stem; the operation stem being fitted in the tubular section of the main body, the ratchets and the recesses being positioned in the passage of the handle section, the operation stem being rotatable within the main body;

two elastic abutment assemblies respectively mounted in the two cavities of the main body, each abutment assembly having an abutment member and an elastic member, the abutment member being engaged with the ratchets of the operation stem, an inner end of the elastic member pressing the abutment member to make the abutment member elastically contact the operation stem;

at least one adjustment member disposed at at least one end of the handle section, the adjustment member abutting against an outer end of at least one of the elastic members, an elastic force applied by the elastic member to the abutment member is adjustable by moving the at least one adjustment member toward or away from the operation stem;

at least one upper support ring disposed between the top section of the operation stem and the handle section of the main body;

at least one middle support ring disposed between the operation stem and the tubular section;

a bottom cap formed with an axial through hole, the bottom cap being connected to the bottom end of the tubular section of the main body, the bottom end of the operation stem being fitted through the through hole of the bottom cap; and a lower support ring located between the operation stem and the bottom cap;

wherein an annular chamber is formed on an inner circumference of the bottom cap between the bottom cap and the operation stem, the lower support ring being fitted around a lower section of the operation stem and located in the annular chamber.

2. The torque screwdriver as claimed in claim 1, wherein an annular groove is formed on a top inner wall face of the handle section, the upper support ring being fitted around the top section of the operation stem and received in the annular groove.

3. The torque screwdriver as claimed in claim 2, wherein a second abutment edge being disposed on a circumference of lower section of the operation stem, the lower support ring being fitted around the lower section of the operation stem and received in the annular chamber, a top edge of the lower support ring abutting against the second abutment edge.

4. The torque screwdriver as claimed in claim 1, wherein a first abutment edge is disposed on a circumference of a middle section of the operation stem, a shoulder section being formed on the inner wall face of the tubular section, the middle support ring being fitted around the middle section of the operation stem, a top edge and a bottom edge of the middle support ring respectively abutting against the shoulder section of the tubular section and the first abutment edge of the operation stem.

5. The torque screwdriver as claimed in claim 1, wherein an annular groove is formed on a top inner wall face of the handle section, the upper support ring being fitted around the top section of the operation stem and received in the annular groove; a first abutment edge is disposed on a circumference of a middle section of the operation stem, a shoulder section being formed on the inner wall face of the tubular section, the middle support ring being fitted around the middle section of the operation stem, a top edge and a bottom edge of the middle support ring respectively abutting against the shoulder section of the tubular section and the first abutment edge of the operation stem.

6. The torque screwdriver as claimed in claim 1, wherein the support rings are metal rings having a hardness lower than a hardness of the operation stem.

7. The torque screwdriver as claimed in claim 1, further comprising a first leakproof member, a second leakproof member and a third leakproof member, the first leakproof member being disposed between the adjustment member and the handle section, the second leakproof member being disposed between the bottom cap and the tubular section of the main body, the third leakproof member being disposed between the operation stem and the through hole of the bottom cap.

8. The torque screwdriver as claimed in claim 1, wherein two ends of the handle section are open, the at least one adjustment member includes two adjustment members, the torque screwdriver further comprising an end cap, the two adjustment members being respectively disposed at two ends of the handle section, the adjustment member respectively abutting against outer ends of the two elastic members, the end cap being disposed at one end of the handle section to block the end, whereby the adjustment member positioned at the end is shielded by the end cap.

9. The torque screwdriver as claimed in claim 8, further comprising a first leakproof member and a second leakproof member respectively disposed between the two adjustment members and the handle section and a third leakproof member disposed between the bottom cap and the tubular section of the main body and a fourth leakproof member disposed the operation stem and the through hole of the bottom cap.

10. The torque screwdriver as claimed in claim 1, wherein the long tooth face of the ratchet has a length over 2 times longer than a length of the short tooth face.

11. The torque screwdriver as claimed in claim 1, wherein the abutment member is a cylindrical pin having a length equal to a length of the ratchet from top side to bottom side.

* * * * *